United States Patent [19]

Störi et al.

[11] 4,365,478

[45] Dec. 28, 1982

[54] SUPPORT FOR A SPHERICAL TANK

[75] Inventors: Heinrich Störi, Winterthur, Switzerland; Walter Averdiek, Georgsmarienhütte, Fed. Rep. of Germany

[73] Assignees: Sulzer Brothers Limited, Winterthur, Switzerland; Klockner-Werke AG, Duisburg, Fed. Rep. of Germany

[21] Appl. No.: 69,504

[22] Filed: Aug. 24, 1979 (Under 37 CFR 1.47)

[30] Foreign Application Priority Data

Aug. 24, 1978 [DE] Fed. Rep. of Germany ..... 2837007
Oct. 26, 1978 [CH] Switzerland ..... 11067/78

[51] Int. Cl.[3] ..... F17C 1/12

[52] U.S. Cl. ..... 62/45; 52/294; 52/302; 62/260; 165/45; 220/18; 220/901

[58] Field of Search ..... 62/45, 260; 165/45; 220/18, 901; 52/292, 294, 302

[56] References Cited

U.S. PATENT DOCUMENTS

| | | | |
|---|---|---|---|
| 2,393,964 | 2/1946 | Boardman | 220/18 |
| 2,563,118 | 8/1951 | Jackson | 220/18 |
| 2,777,295 | 1/1957 | Bliss et al. | 62/45 |
| 3,076,317 | 2/1963 | La Fare | 52/292 |
| 3,246,479 | 4/1966 | Kelley | 62/45 |
| 3,791,443 | 2/1974 | Burt et al. | 62/260 |

*Primary Examiner*—Ronald C. Capossela
*Attorney, Agent, or Firm*—Kenyon & Kenyon

[57] ABSTRACT

The support has a filling of insulating concrete which fills the space between the foundation slab and sand support layer. A cold sink formed of horizontal pipes laid in the main wind direction is encased in a middle region of the support. An impermeable film is placed over the cold sink and about the filing to prevent entry of moisture into the filling.

15 Claims, 3 Drawing Figures

SUPPORT FOR A SPHERICAL TANK

This invention relates to a support for a spherical tank and to a method of making the same.

As is known, spherical tanks have frequently been mounted directly on a support having a support surface to accommodate the tank. For example, as described in Swiss Pat. No. 418,611, one known support is constructed of a foundation slab, a ring which is mounted on the slab to define a trough and a layer of sand which is disposed within the ring to carry the support tank. However, a support of this kind has a disadvantage in being unsuitable for low temperature storage, that is, for storing media whose temperature is below the lowest outside temperature. This is because a lentil-like layer of ice, resulting in an inadmissible lifting and subsidence, may form beneath the spherical tank in the region of the sub-soil and, possibly, in the region of the support itself.

Accordingly, it is an object of the invention to provide an inexpensive support for a spherical storage tank containing low-temperature materials.

It is another object of the invention to provide a support for a spherical tank in which the risk of lifting and subsidence is substantially reduced.

Briefly, the invention provides a support for a spherical tank which is comprised of a foundation slab, an outer boundary ring mounted on the slab to define a peripherally enclosed space, a filling of insulating concrete in the space and having an upper spherical surface, and a layer of sand on the surface of the filling to receive a spherical tank thereon. By using a filling of insulating concrete, the danger of a lentil-like layer of ice forming is substantially reduced.

The support has an advantage in that any deformation of the spherical tank which may occur during filling or emptying of the tank is taken vertically by an elastic yielding of the insulating concrete filling since the filling has a low modulus of elasticity. Also, tangential relative displacements between the spherical tank and the insulating concrete filling can be taken by the layer of sand without appreciable tangential forces occurring on the spherical tank or the insulating concrete filling. Further, the additional stresses operative in the region of the spherical tank support are easily kept to a minimum and, in many cases, there is no need to increase the thickness of the tank in the region of the support.

In order to facilitate the tangential relative displacement of the spherical tank in the region of the support surface, the layer of sand may consist of quicksand since quicksand is characterized as being very mobile.

Further, the sand layer may consist of dry quartz sand of a particle size of from 0.2 to 1.0 millimeter. The advantage of this is that quartz sand is non-hydroscopic and the narrow particle size insures a ready flow.

The support may also be provided with a means defining a cold sink above the foundation slab in a middle height zone of the support for interrupting a cold stream from the tank. This prevents the soil beneath the support from being super-cooled with the formation of a lentil-like layer of ice even when the medium stored in the spherical tank has a very low temperature. The means for forming the cold sink may include a plurality of horizontally disposed aeration pipes which extend through the filling and the ring. Such pipes should be laid in the main wind direction so as to permit air to readily flow through the pipes for transfer the cold to the air instead to the soil.

The means for defining the cold sink may also include a heating system for maintaining a predetermined temperature. Such a cold sink can be made adjustable so that the heat loss and/or the thermal stresses in the insulating concrete filling can be minimized. In this regard, the heating system may include a heat-emitting unit of a refrigeration circuit for maintaining the contents of the spherical tank on the layer of sand cold. This provides a savings in the energy required for cooling.

In order to prevent moisture from the air from penetrating into the insulating concrete filling, a vapor impermeable film encloses the filling above the cold sink.

A breather pipe may also extend from a lower most point of the surface of the filling through the filling to a point outside the boundary ring. Such a breather pipe allows any leakage near the support to be detected and, if the vapor impermeable film is not completely impermeable, enables the sand layer to be drained on heating up of the spherical tank.

The method of making the support for the spherical tank includes a series of relatively simple steps. In this regard, the method includes the steps of forming a concrete trough having a foundation slab and a boundary ring thereon, of fabricating a form outside the trough comprised of an inverted spherical sheet steel plate and an annular wall mounted on the plate and of pouring an insulating concrete into the form to form a base upon setting of the concrete. Thereafter, the formed base is mounted in inverted manner centrally within the trough to define an annular cavity with the boundary ring and with the spherical surface at the upper end. Thereafter, the annular cavity is filled with insulating concrete.

One inexpensive way of insuring that the layer of sand between the support surface of the insulating concrete filling and the spherical surface of the tank is of a uniform thickness is to place the steel plate on the base and to weld a plurality of sheet metal segments for a spherical tank to the steel plate prior to filling of the annular cavity with the insulating concrete. In this way, the spherical tank acts as a form for the upper surface of the concrete filled into the cavity. This practically eliminates the risk of any lateral shift of the spherical tank. After the filling has set, the spherical tank can be lifted from the base in order to define a gap and a layer of sand can be introduced into the gap.

These and other objects and advantages of the invention will become more apparent in the following detailed description taken in conjunction with the accompanying drawings wherein.

Figure 1:
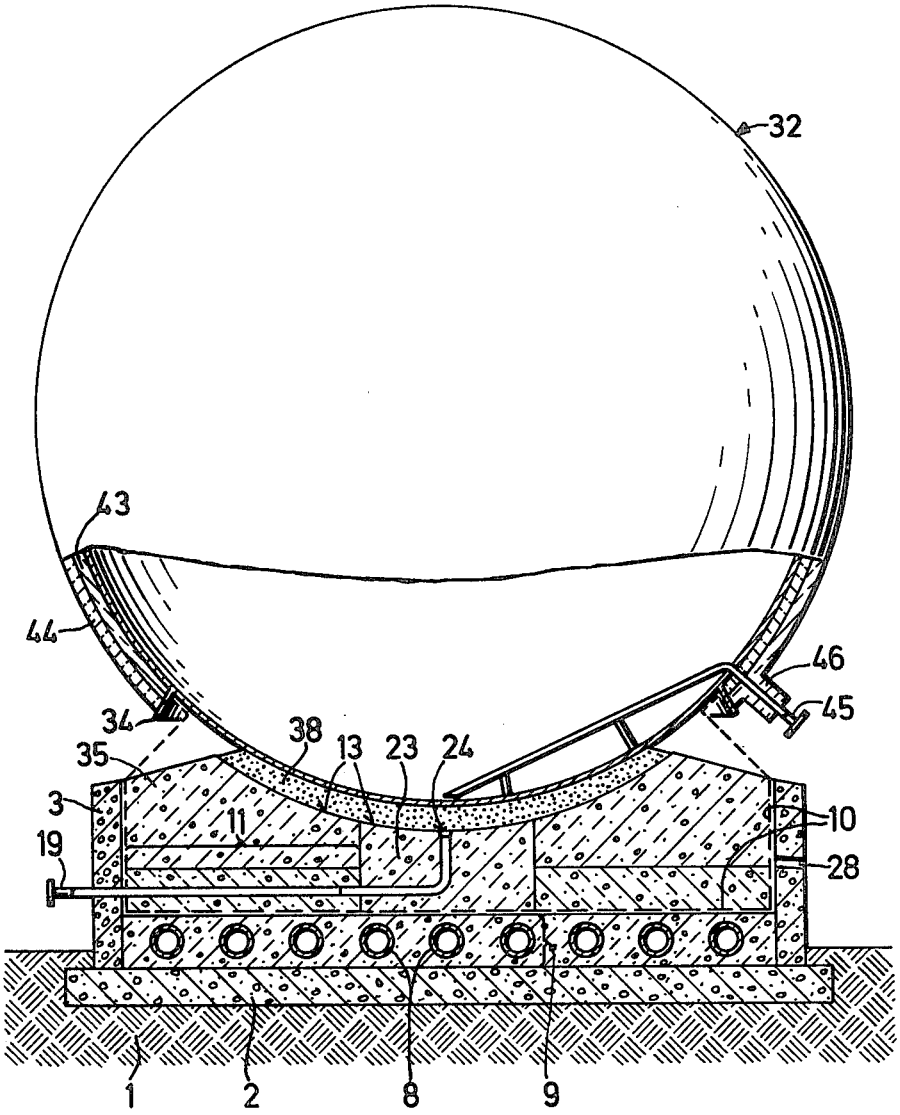
FIG. 1 illustrates a section through a support according to the invention with a spherical tank mounted thereon.

Referring to FIG. 1, the support for a spherical tank 32 is disposed on a suitable soil 1. The support includes a foundation slab 2 which is sunk into the soil 1 and an outer boundary ring 3 which is mounted on the slab 2 to define a peripherally enclosed space. In addition, a filling of insulating concrete is disposed in this space and has an upper spherical surface 13 on which a layer of sand 38 is disposed to receive the spherical tank 32.

The filling includes a first layer 9 of insulating concrete on the slab 2, a base 23 of insulating concrete which is disposed on the first layer 9 to define an annular cavity 11 with the boundary ring 3, and at least one additional layer 35 of insulating concrete in the annular cavity 11. In addition, a vapor impermeable film or sheet 10 encloses the filling layer 35 above the first layer 9. As indicated, the film 10 is disposed across the top surface of the layer 9 and extends upwardly along the inner surface of the boundary ring 3.

The first layer 9 is provided with a means to define a cold sink above the slab 2 in a middle height zone of the support. This means is in the form of a plurality of horizontally disposed aeration pipes 8 which extend through the layer 9 and the ring 3.

The base 23 has a upper spherical support surface 13 as well as a breather pipe 19 which extends from a lowermost point 24 of the surface 13 through the filling layer 35 to a point outside the boundary ring 3. When the spherical tank 32 is heated up, for example for inspection, any damage to the sheet 10 can be determined by water of condensation flowing out through the breather pipe 19.

The filling layer 35 can be made up of a multiplicity of layers, for example as described below.

The spherical tank 32 can be insulated on the outside surfaces by means of mineral sheets 43 and a layer of polyurethane hard foam 44. In addition, an extraction pipe 45 which is connected to the interior of the tank 32 may also be provided with an insulating layer 46.

The boundary ring 3 can be provided with apertures 28 so that when the annular space 11 is filled with the additional layer 35, surplus water can escape via the apertures 28. After the layers of insulating concrete have set, these apertures 28 can be closed. In addition, a drip edge 34 can be provided in the bottom zone of a tank 32 to prevent rain from passing between the tank 32 and the foundation during erection.

Figure 2:
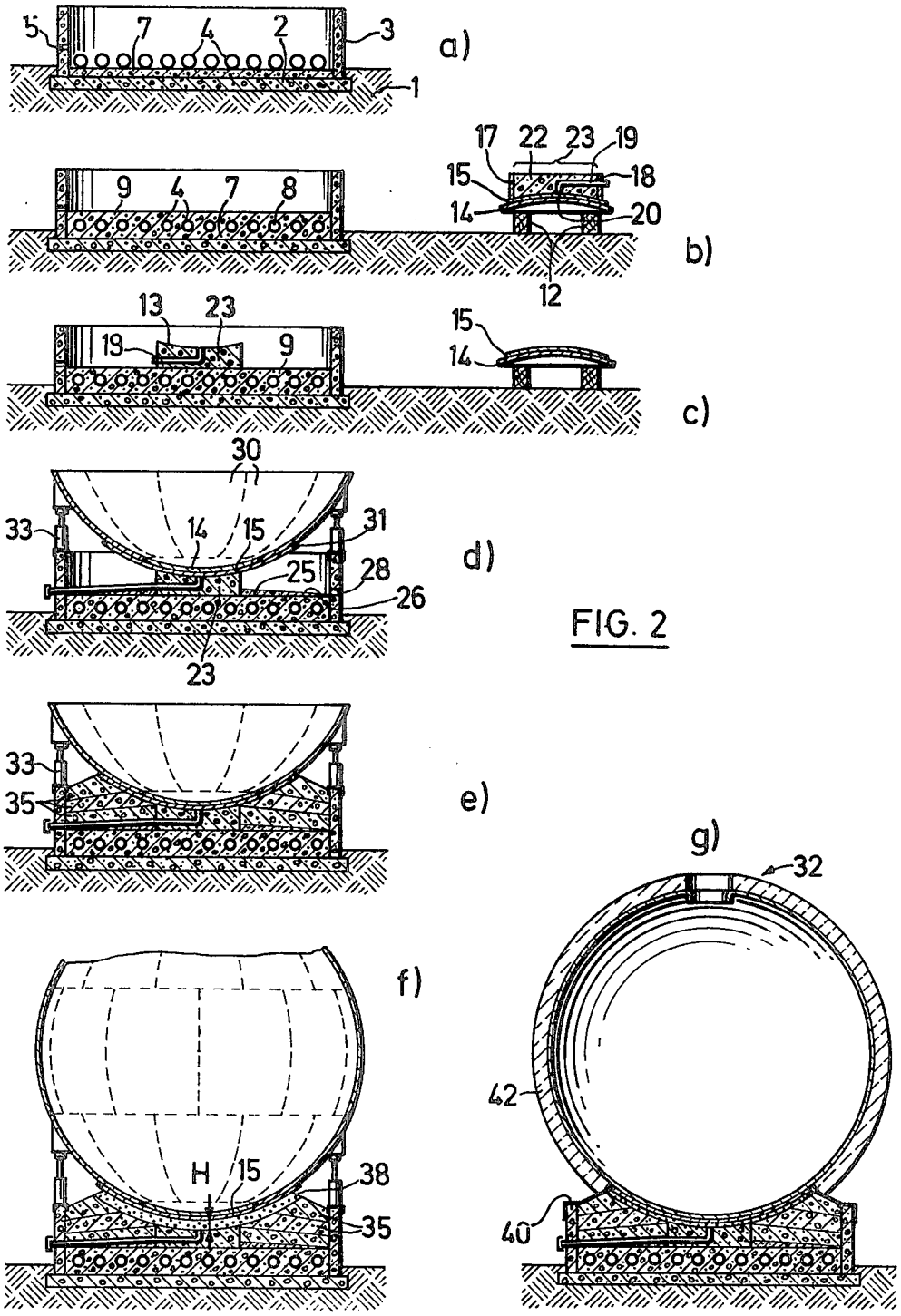
FIG. 2 illustrates the support at various stages during erection in accordance with the invention.

The method of erecting the support and tank will be described with reference to FIG. 2.

As shown in FIG. 2*a*, concrete is initially poured at the erection site in the excavated soil to form the foundation slab 2. The foundation slab 2 may be slightly sunk into the soil and preferably consists of high strength reinforced concrete. The load bearing capacity of the soil 1 on which the foundation slab 2 rests can be improved, for example by compaction, by the introduction of gravel, or by piling, depending upon local conditions. Thereafter, a reinforced concrete boundary ring 3 is disposed on the foundation slab 2 and, preferably, rests loosely on the slab 2 to define a trough. This ring 3 is provided with a plurality of cylindrical apertures 4, for example 24 apertures, in a horizontal plane, as well as a cylindrical aperture 5 above the plane of the apertures 4. In addition, a bottom layer 7 of insulating concrete is placed in the trough up to the level of the apertures 4. This layer 7 may consist of a plurality of individual layers each of which is introduced after the preceding layer has set. The insulating concrete consists, for example, of a cement mixture containing Styropor-R pellets. An insulating concrete of this kind has special advantages in that the concrete maintains its insulating properties over a long time independent of moisture influence. The foam pellets within the concrete are, advantageously, of a diameter of about 2 millimeters. The bulk density of the finished insulating concrete is advantageously within a range of from 300 to 1,000 kilograms per cubic meter and preferably 600 kilograms per cubic meter.

Referring to FIG. 2*b*, in order to form a cold sink within the trough, a plurality of aeration pipes 8 are pushed through each pair of opposed apertures 4 in the boundary ring 3. To this end, the pipes 8 are sized to bear on the layer 7 and terminate flush with the outer cylindrical surface of the boundary ring 3. Thereafter, the pipes 8 are embedded in at least one insulating concrete layer 9 to form the cold sink. The surface of this layer 9 is then smoothed at least in the central zone. If required, a special morter can be used to provide a flat surface.

As also shown in FIG. 2*b*, a form is fabricated outside the trough from an inverted spherical sheet steel plate 14 of the tank and an annular wall 17 which is mounted on the plate 14. As shown, the steel plate 14 rests on two beams 12 in an inverted manner, that is, in a convex position with an already bevelled or machined edge extending downwards. This plate 14 is preferably protected against corrosion and abrasion at this stage by means of a protective layer 15. The annular wall 17 is disposed on the protective layer 15 and is aligned with the center of the plate 14. The annular wall 17 is also provided with a circular cutout 18 through which the longer arm of an angular breather pipe 19 is positioned with the open end 20 of the short arm of the pipe 19 in seal-tight relation with the protective layer 15 at the center of the plate 14. Thereafter, a mixture of insulating concrete 22 is poured into the form to form a base 23 having a spherical surface on the bottom upon setting of the concrete. The pouring process may be carried out in a number of stages after each of the layers has set in turn.

Referring to FIG. 2*c*, the formed concrete base 23 is then mounted in inverted manner centrally within the trough on the cold sink layer 9 to define an annular cavity with the boundary ring 3. As shown, the spherical surface 13 of the base 23 is now disposed at the upper end. After positioning of the base 23 on the layer 9, the annular wall 17 of the form can be stripped. The mounting of the base 23 on the layer 9 may be carried out, if desired, after a thin readily flowing layer of mortar has been applied to the layer of insulating concrete 9. As also shown in FIG. 2*c*, the steel plate 14 and the covering protective layer 15 remain on the beams 12 outside of the trough defined by the slab 2 and boundary ring 3.

Referring to FIG. 2*d*, an extension 19' is then secured to the longer arm of the breather pipe 19 to extend through the boundary ring 3. As shown, this extension 19' extends through the aperture 5 in the boundary ring 3. Thereafter, another layer 25 of insulating concrete is applied in the annular space between the base 23 and the ring 3. This layer 25 is sloped down and in an outward direction from the base 23. In addition, a screed 26 is provided on the layer 25 and is of a higher strength than the layer 25 in order to protect the layer 25 from mechanical and moisture influences during further operations. The film 10 (FIG. 1) which may be in the form of a thick plastic is then placed on the set screed 26.

As shown in FIG. 2*d*, the boundary ring 3 has radial holes 28 which terminate above the screed 26 on the inside so that any rainwater can flow off through the holes 28 during erection.

After the layer 25 and screed 26 have been formed, the steel plate 14 is placed on the upper surface 13 of the base 23 with the protective layer 15 between the plate 14 and the base 23. Next, at least one row of sheet metal segments 30 for forming a spherical tank are welded to the steel plate 14. These segments 30 may be of spherical-rectangular shape to form a spherical zone when welded to the plate 14 and are supported for welding, inter alia, by hydraulically extensible jacks 33 which rest on the boundary ring 3. After the weld seams have been tested and cleaned, and after the surfaces have been suitably cleaned, the protective layer 15 is raised under the segments 30, for example as far as the indicated circular line 31.

Referring to FIG. 2*e*, the cavity between the base 23 and the boundary ring 3 can then be filled with insulated concrete filling. As indicated, three layers 35 of insulating concrete are poured and set in the annular cavity between the base 23 and boundary ring 3 and between the cold sink layer 9 and the sheet metal segments 30. As indicated, the top layer 35 contacts the protective layer 15 as far as the circular line 31.

Referring to FIG. 2*f*, the spherical tank 32 can thereafter be substantially completed by the welding of additional segments to the previously welded segments 30. After the welding operation, the jacks 33 are actuated to lift the formed tank 32 from the base 23 to define a gap H of from 3 to 30 centimeters between the base 23 and adjoining insulating concrete layer 35 on one side and the protective layer 15 on the other side. Washed quartz sand 38 of a comparatively narrow particle size fraction, for example from 0.2 to 1.0 millimeters particle size, is then introduced, e.g., by being blown, into the gap H to an essentially uniform thickness. During this step, the sand is tamped down well.

Referring to FIG. 2*g*, the hydraulic jacks 33 can thereafter be lowered and removed. At this time, the spherical tank 32 comes to rest directly on the layer of sand 38. The insulating concrete layers are then covered by means of a sheet metal collar 40 which is disposed, preferably, adjacent to the drip edge 34 and the tank 32 is provided with insulation 42.

It may be advantageous to provide the top layer 35 of insulating concrete with reinforcement in order to limit elastic deformation. It may also be advantageous to seal off the top layer 35 from the air humidity by means of a vapor barrier, for example, the film 10 may be continued upwards as far as the protective layer 15. In this way, the layer of sand 38 is also protected from moisture penetrating into the layer. The film 10 may also be connected to the drip edge 34 of the spherical tank as indicated in dotted line in FIG. 1.

Instead of using aeration pipes 8 to define the cold sink, a heating system may be used as the cold sink means. For example, the heating system may be in the form of electrical resistance wires or networks of the kind used, for example, for viaduct heating systems. In this case, the heating system serves to maintain a predetermined temperature distribution in the support. To this end, temperature sensors may be provided in the insulating concrete filling to control the heating system. Such a heating system may be used to minimize the heat loss with a specific critical temperature being maintained in the transition zone of the soil accessible to the ground moisture or in order to maintain certain limits for the thermal stresses in the insulating concrete filling, particularly during the transient thermal phases taking place when the tank is filled and emptied.

It may also be advantageous to alternate the control of such a cold sink to serve each purpose in turn.

Figure 3:
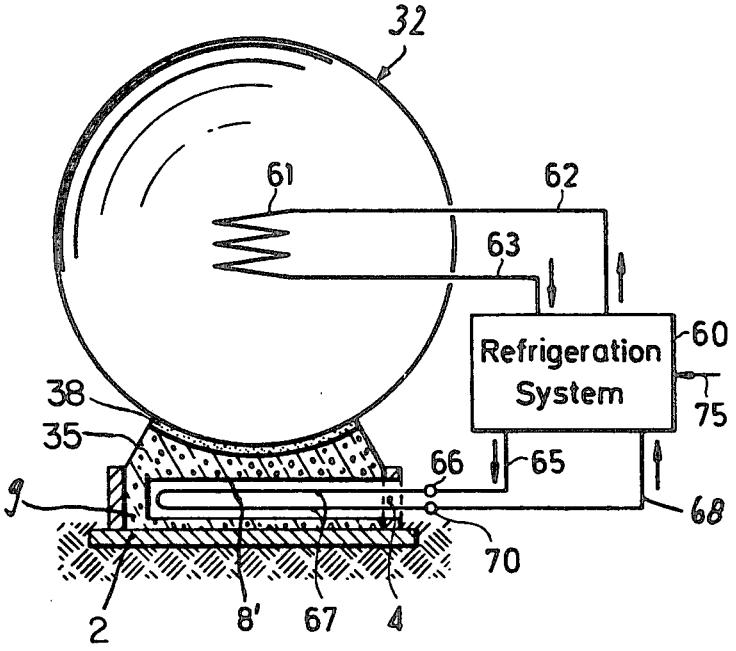
FIG. 3 schematically illustrates a spherical tank interconnected with a refrigeration system in accordance with the invention.

The support is particularly advantageous in terms of energy if the cold sink is used as a refrigerating circuit unit which delivers heat to the surroundings. For example, the heating system may be in the form of a heat-emitting unit of a refrigeration circuit for maintaining the contents of the tank cold. As shown in FIG. 3, the refrigeration circuit employs a refrigeration system 60 of conventional construction which connects to a coil 61 within the tank 32 via a coolant supply line 62 and a coolant removal line 63. Thus, cooling of the contents of the tank 32 occurs via the coolant supplied by the refrigeration system 60. The heat is removed via the coolant flowing through the line 63 to the refrigeration system 60. A portion of this heat is then radiated to the cold sink via a line 65. As indicated in FIG. 3, the cold sink is comprised of hair pin shaped pipes 67 which are respectively housed in a pipe A′ and connected to the line 65 via a distributor 66. The outlets of the pipes 67 are connected to a collector 70 from which a line 68 leads back to the refrigeration system 60. Thus, the cold flow from the tank 32 in the direction of the slab 2 via the sand layer 38 and insulated concrete filling layer 35 is interrupted by the heat radiation in the pipes 67.

The refrigeration system 60 may be driven, for example by an electric drive energy supply 75.

The remaining heat absorbed by the coolant in the pipe coil 61 can be emitted in a separate heat exchanger (not shown) which can be installed in line 68 or which is connected in parallel to the cold sink formed by the pipe 67. The heat can be emitted, for example, to the ambient air.

Insulating concrete, particularly concrete mixed with foam pellets not only provides thermal insulation but also has the advantage of a very low modulus of elasticity, of the order of 10,000 bar. This gives an excellent equalization of the support pressures and reduced material stresses in the spherical tank.

In order to prevent the entering of sand into the breather pipe 19 a filter means (not shown) is provided at the upper end of this pipe.

What is claimed is:

1. A support for a spherical tank comprising
a foundation slab;
an outer vertically disposed boundary ring mounted on said slab to define a peripherally enclosed space;
a filling of insulating concrete in said space, said filling having an upper spherical surface; and
a layer of sand of essentially uniform thickness on said spherical surface of said filling to receive a spherical tank thereon.

2. A support as set forth in claim 1 wherein said layer of sand consists of quicksand.

3. A support as set forth in claim 1 wherein said layer of sand consists of dry quartz sand of a particle size of from 0.2 to 1.0 millimeters.

4. A support as set forth in claim 1 which further comprises means defining a cold sink above said slab in a middle height zone of said support.

5. A support as set forth in claim 4 wherein said means includes a plurality of horizontally disposed aeration pipes extending through said filling and said ring.

6. A support as set forth in claim 4 wherein said means includes a heating system for maintaining a predetermined temperature.

7. A support as set forth in claim 6 wherein said heating system is a heat-emitting unit of a refrigeration circuit for maintaining the contents of a tank on said layer of sand cold.

8. A support as set forth in claim 4 which further comprises a vapor impermeable film enclosing said filling above said cold sink.

9. A support as set forth in claim 1 which further comprises a breather pipe extending from a lowermost part of said surface through said filling to a point outside said boundary ring.

10. A support as set forth in claim 1 wherein said filling includes a first layer of insulating concrete on said slab, a base of insulating concrete disposed on said first layer to define an annular cavity with said boundary ring, and at least one additional layer of insulating concrete on said annular cavity about said base.

11. A support as set forth in claim 10 which further comprises a plurality of horizontally disposed aeration pipes extending through said ring and said first layer to define a cold sink.

12. A support as set forth in claim 10 which further comprises a breather pipe extending from a lowermost point of said surface through said base and said additional layer to a point outside said boundary ring.

13. A support as set forth in claim 10 which further comprises a vapor permeable film above said first layer enclosing said additional layer and said base.

14. In combination, a support comprising a foundation slab, an outer vertically disposed boundary ring mounted on said slab to define a peripherally enclosed space, a filling of insulating concrete in said space, said filling having an upper spherical surface and a layer of sand of essentially uniform thickness on said surface of said filling; and a spherical tank disposed on said layer of sand of said support.

15. The combination as set forth in claim 14 wherein said support further comprises a plurality of horizontally disposed aeration pipes extending through said filling and said ring to define a cold sink.

* * * * *

UNITED STATES PATENT AND TRADEMARK OFFICE

CERTIFICATE OF CORRECTION

PATENT NO. : 4,365,478

DATED : December 28, 1982

INVENTOR(S) : HENRY STOERI, ET AL

It is certified that error appears in the above—identified patent and that said Letters Patent is hereby corrected as shown below:

Column 2, lines 1 and 2, after "transfer" insert --of--; after "instead" insert --of--.

Signed and Sealed this

*Twenty-first* Day of *June 1983*

[SEAL]

*Attest:*

DONALD J. QUIGG

*Attesting Officer*

*Acting Commissioner of Patents and Trademarks*